United States Patent [19]

Hemsath

[11] Patent Number: 4,781,171

[45] Date of Patent: Nov. 1, 1988

[54] GAS FIRED PARTICULATE MELTING APPARATUS AND METHOD

[75] Inventor: Klaus H. Hemsath, Toledo, Ohio

[73] Assignee: Indugas, Inc., Toledo, Ohio

[21] Appl. No.: 70,224

[22] Filed: Jul. 6, 1987

[51] Int. Cl.[4] ..... F24H 1/00

[52] U.S. Cl. ..... 126/343.5 A; 432/13; 432/14; 432/248; 126/343.5 R

[58] Field of Search ..... 126/116, 343.5 R, 343.5 A; 432/13, 248, 14

[56] References Cited

U.S. PATENT DOCUMENTS

| | | | |
|---|---|---|---|
| 2,303,657 | 12/1942 | Parsons | 266/38 |
| 3,015,480 | 1/1962 | Nawrath et al. | 126/343.5 A |
| 3,163,888 | 1/1965 | Shattuck | 126/343.5 A X |
| 3,944,713 | 3/1976 | Plumat et al. | 13/6 |
| 4,032,288 | 6/1977 | Numerowski | 126/343.5 X |
| 4,248,616 | 2/1981 | Seng et al. | 65/335 |
| 4,328,019 | 5/1982 | Dajaiffe et al. | 65/19 |
| 4,474,311 | 10/1984 | Petrecca | 126/343.5 R X |

*Primary Examiner*—Larry Jones

*Attorney, Agent, or Firm*—Harold F. Mensing

[57] ABSTRACT

A liquid fuel fired apparatus and method for the efficient distribution and utilization of heat in the melting of a particulate feedstock. The feedstock is preheated to an incipient softening point temperature in a vertically disposed shaft. The column of feedstock in the shaft is supported on the top of a freestanding pile of feedstock disposed on the floor of a surrounding melting chamber having downwardly diverging sidewalls. Liquid fuel burners direct hot combustion products towards and around the base and intermediate portions of the feedstock pile causing the outside of the pile to be melted. Gas at a temperature below the softening point temperature of the feedstock is introduced around the top of the pile to prevent the hot gases in the lower portion of the melting chamber from prematurely melting the feedstock.

17 Claims, 1 Drawing Sheet

GAS FIRED PARTICULATE MELTING APPARATUS AND METHOD

BACKGROUND OF THE INVENTION

This invention relates to a liquid fuel fired melting furnace for particulate material and more particularly it relates to a furnace apparatus with a shaft preheater section mounted above a melting chamber wherein the surface of a lower portion of a free-standing pile of preheated feedstock is melted.

The initial objective of this invention disclosed herein was to solve various problems relating to the melting of blast furnace slag and other siliceous raw materials for the production of mineral wool insulation. Normally the melting process was carried out in a cupola or shaft type furnace into the top of which the raw material was fed along with a solid fuel, such as a metallurgical coke. The fuel was ignited and combustion air was circulated upwardly from the bottom of the furnace through the mixture of raw material and fuel. This caused the fuel to be consumed, heat to be produced and the raw material to be melted. The melted material gravitated to the bottom of the furnace where it was drawn off and formed into mineral wool. Additional raw material and fuel were fed intermittently or continuously into the top of furnace to replenish the portion of the mixture which was consumed or melted.

A recent problem with the process is that the cost of the high quality coke required to produce a suitable product has risen significantly. Another problem which has plagued prior art processes using solid carbonaceous fuel is that the intimate contact between the melted material and the unburned fuel, particularly at the high temperatures involved, resulted in contamination of the product by the fuel. At times the flue gases which were emitted from the furnace contained contaminants, especially if a sulfur containing solid fuel were used, and thus had to be treated by anti pollution devices before they could be discharged into the atmosphere. Another critical problem was the lack of operational controls. After an effective particle size had been selected along with the proper ratio of fuel in the charge, the only remaining controllable variable in the process was the flow rate of combustion air through the furnace. All of these factors added to the cost of production or difficulty of operation.

Natural gas appeared to be an ideal alternative fuel because it is a relatively clean burning fuel and thus will not contaminate the feedstock material or create an air pollution problem if it is used properly. Also in most instances it is more economical to use than other sources of heat. However, when slag or a similar particulate material was melted in a shaft furnace by itself, rather than in a mixture containing a solid fuel, it tended to coalesce randomly in the shaft thereby impeding the uniform upward flow of hot combustion gases through the load and also impeding the uniform downward flow of the feedstock.

Accordingly it is a general object of this invention to solve the aforementioned problems and to provide an improved liquid fuel fired furnace apparatus and related method for economically melting flowable particulate material. It is another object to provide such a furnace and method which have more controllable variables and thus are operationally more flexible. It is still another object of this invention to provide a melting furnace with a gas fired heating system which effectively distributes and efficiently utilizes the products of combustion to preheat and melt particulate feedstock, such as blast furnace slag.

SUMMARY OF THE INVENTION

The particulate melter disclosed herein is a liquid fuel fired furnace apparatus having a vertically disposed cylindrical preheater section or shaft supported over the open top of a coaxially disposed melting chamber. Flowable particulate feedstock is introduced into the top of the vertically disposed preheater shaft to form a foraminous column of feedstock which is preheated to an incipient softening point temperature by gases flowing upwardly from the melting chamber. The bottom of the column of feedstock in the shaft is supported on the top of a freestanding pile of feedstock contained in the surrounding melting chamber. The melting chamber has downwardly diverging sidewalls which are sized and designed with respect to the bottom end of the preheater shaft such that the sidewalls remain spaced from the surface of the freestanding pile of feedstock. Liquid fuel burners direct hot combustion products towards and around the base and middle portions of the feedstock pile causing the surface of these portions to be melted. Gas at a temperature below the softening point temperature of the feedstock is introduced around the top portion of the pile to prevent hot gases in the lower portions of the melting chamber from prematurely softening or melting the feedstock in this region. A reservoir for holding the molten material is located at the lower end of the melting chamber floor.

Preferably the system for generating and distributing the heat includes a liquid fuel fired heat exchanger for producing heated air and cooled combustion gases. The heated air is conveyed to high temperature burners in the melting chamber while the cooled gases are conveyed to the top portion of the melting chamber.

DETAILED DESCRIPTION OF THE INVENTION

Figure 1:
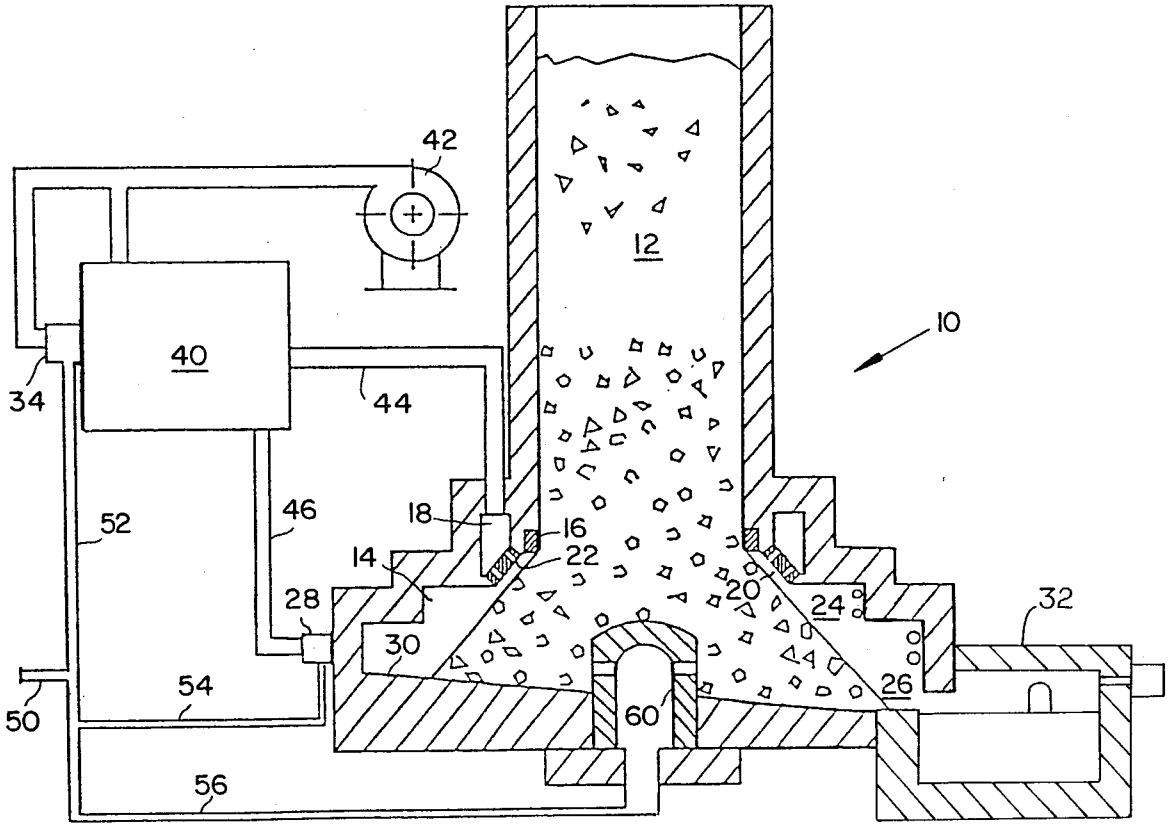
FIG. 1 is a schematic elevational view of the melting furnace apparatus with portions of it shown in cross section.

Referring to the drawing the liquid fuel fired melting apparatus 10 has a vertically disposed hollow cylindrical preheater section 12 which is open at both ends and made of suitable refractory material. The open bottom end of the preheater section is mounted concentrically on the open too of a generally frustoconical shaped chamber 14 defined by refractory sidewalls which extend outwardly and downwardly from the open end of the preheater section. A high density wear resistant refractory ring 16 having a sharp inner edge and a horizontally disposed bottom surface exposed to the chamber is provided on the inside corner of the bottom of the preheater section 12 to enhance an abrupt separation of the feedstock from contact with the surrounding wall. An annular manifold 18 for injecting cooled combustion gases is disposed around the top section 20 of the chamber. The manifold 18 has a plurality of inwardly and downwardly directed et apertures 22 extending through the inclined inner surface of the melting chamber adjacent to the separator ring 16. The lower portion of the chamber 14 where the actual melting occurs is divided into an intermediate section 24 and a bottom section 26.

High temperature liquid fuel burners 28 fire tangentially into each of these lower sections. The intense heat produced by the burners causes the surface of the freestanding pile of preheated feedstock to melt and cascade to the floor 30 of the melting chamber. Preferably the floor 30 is sloped towards one side so that the melted material will gravitate to the lower end thereof where it can be drawn off or collected in a reservoir or forehearth 32 for additional processing.

Heat is generated and distributed through the furnace by a means which includes a first combustion system for producing heated air and cooled combustion gases. It has a liquid fuel fired burner 34 incorporated into a heat exchanger 40. Air is fed under pressure to the burner 34 and also through one side of the heat exchanger 40 from a common source, such as a compressor or blower 42. The combustion products or gases, which are cooled as they travel through the other side of the heat exchanger, are conveyed to annular manifold 18 via conduit 44. In the process the air flowing through the first side of the heat exchanger becomes heated. This heated air is transferred from the heat exchanger via conduit 46 to a second combustion system which includes high temperature melting chamber burners 28. Fuel is fed to both combustion systems through a main fuel supply pipe 50 and then to the respective systems through branch lines 52, 54. Another branch line 56 may be used to inject reducing gas to a distributor dome 60 projecting upwardly from the center of the melting chamber floor 30 into the bottom portion of the freestanding pile of preheated feedstock. Preferably the fuel used in the systems is natural gas, but if conditions warrant then other liquid fuels could be used.

The operating process involves the introduction of a flowable particulate feedstock into the top of the preheater section to form a foraminous column of feedstock therein. The bottom of the column is supported on the top of a freestanding pile of preheated feedstock disposed on the floor of the surrounding melting chamber. High temperature burners fire into the lower portions of the melting chamber causing the feedstock on the surface of the pile in these regions to be melted. The melted material gravitates to the sloped floor and then travels down the slope of the floor to a reservoir located at its lower end where it may be processed further or drawn off for immediate use.

Cooled combustion oases from the heat exchanger of the first combustion system are introduced through an annular manifold on the top of the melting chamber to envelope the top portion of the feedstock pile and prevent the hot combustion gases and radiation from the lower section of the melting chamber from melting or softening the feedstock in the top of the pile. The flow rate of the cooled combustion gases into the chamber may be varied during operation as well as the combustion rate of the high intensity burners so as to maximise melting efficiency.

The column of feedstock in the preheater is heated to an incipient softening point temperature by an upwardly flowing mixture of cooled combustion gases from the too of the melting chamber and hot combustion gases from the lower portions of the melting chamber. The temperature profile in the preheater increases from top to bottom and from outside to inside whereas the temperature profile in the pile of feedstock in the melting chamber increases from inside to outside. A reducing gas may be introduced into the bottom center of the pile to provide additional process control.

Although the invention is described with respect to a single illustrated embodiment, it is to be understood that modification can be made without departing from the scope of the invention which is defined by the appended claims.

I claim:

1. A liquid fuel fired furnace apparatus for melting particulate material, said apparatus comprising: a vertically disposed hollow cylindrical shaft for preheating a foraminous column of flowable particulate feedstock, said shaft having an open bottom end, a concentrically aligned chamber for containing a freestanding pile of feedstock, said chamber being disposed directly below said open bottom end, said chamber having top, bottom and intermediate portions defined by refractory sidewalls and a refractory floor, said sidewalls having inner surfaces which extend downwardly and outwardly from said open bottom end to said floor, a plurality of high temperature burners firing into said intermediate and bottom portions of said chamber and a means for injecting relatively cooler gases from a remote source into said top portion of said chamber.

2. A furnace according to claim 1 wherein said means for injecting cooler gases includes an annular manifold extending around the top portion of said chamber.

3. A furnace according to claim 1 wherein said remote source is a fuel fired heat exchanger means for producing heated air and cooled combustion gases.

4. A furnace according to claim 3 further including means for conducting said heated air under pressure from said heat exchanger to said high temperature burners.

5. A furnace according to claim 1 further including a means for injecting a reducing gas into said chamber through said floor.

6. A furnace according to claim 1 wherein said floor is inclined towards one side and a reservoir for holding molten product is disposed at the lower end thereof.

7. A furnace according to claim 1 wherein the inner edge of the bottom of said preheater column is circular and is provided with a high density annular refractory member having a relatively sharp inner edge and a horizontally disposed bottom surface exposed to said chamber.

8. A further according to claim 1 wherein said furnace has a fuel combustion system including a heat exchanger for producing heated air and cooled combustion gases, means for conveying said heated air under pressure to said high temperature burners, and means for conveying said cooled combustion gases to the top of said chamber.

9. A liquid fuel fired furnace apparatus for melting flowable particulate material, said apparatus comprising: a vertically disposed hollow cylindrical shaft for preheating a foraminous column of flowable particulate feedstock, said shaft having a circular open bottom end, a concentrically aligned chamber for containing a feedstanding pile of preheated feedstock, said chamber being disposed directly below said bottom end in open communication therewith, said chamber having top, bottom and intermediate portions defined by refractory sidewalls and a refractory floor, said sidewalls having inner surfaces which extend downwardly and outwardly from said open bottom end to said floor, a first fuel combustion system having a heat exchanger for producing heated air and cooled combustion gases, a second combustion system having a plurality of high temperature burners firing into the intermediate and bottom portions of said chamber, a means for conveying said heated air under pressure from said first system to the burners of said second system, and means for conveying said cooled combustion gases from said first system into the top of said chamber.

10. A furnace according to claim 9 wherein said means for conveying cooled combustion gases includes an annular manifold extending around the top portion of said chamber.

11. A furnace according to claim 10 wherein said manifold has aperture means for directing cooled combustion gases inwardly and downwardly from said manifold.

12. A furnace according to claim 9 further including a means for injecting a reducing gas into said chamber through said floor, said reducing gas injecting means being coaxially disposed in said chamber.

13. A furnace according to claim 9 wherein said floor is inclined towards one side and has a reservoir for holding molten product disposed at the lower end thereof.

14. An improved method of melting particulate material comprising the steps of: introducing particulate material into the top of a vertically disposed preheater shaft, supporting said particulate material in said preheater shaft on a freestanding pile of preheated particulate material disposed on an inclined floor of a melting chamber, enveloping a top portion of said free standing pile with cooled combustion gases from a remote source, subjecting the intermediate and base portions of said pile to intense heat capable of melting the particulate material on the outside surface of said pile, allowing the melted material to gravitate to the lower end of said slope, and collecting said melted material in a reservoir at the bottom of the slope.

15. An improved method of melting particulate material according to claim 14 further including the steps of supplying a combustible mixture of fuel and air to a first burner system, conveying combustion products from said burner system through one side of a heat exchanger, conveying air through another side of said heat exchange to produce heated air and cooled combustion gases, conveying said heated air to a second combustion system firing into said melting chamber, and conveying said cooled combustion gases to an annular manifold disposed around the top portion of said melting chamber.

16. An improved method of melting particulate material according to claim 14 including the step of introducing a reducing gas into the central bottom portion of said pile.

17. An improved method of melting particulate material according to claim 14 including the step of maintaining said particulate material in said preheater at a temperature level below its softening point temperature.

* * * * *